United States Patent [19]

Harris

[11] Patent Number: 4,850,922

[45] Date of Patent: Jul. 25, 1989

[54] FLIGHT SIMULATING TOY

[76] Inventor: Allen R. Harris, 704 Jefferson St., Portsmouth, Va. 23704

[21] Appl. No.: 191,404

[22] Filed: May 9, 1988

[51] Int. Cl.[4] ..... A63H 17/00; A63H 33/00; A63H 27/00

[52] U.S. Cl. ..... 446/7; 446/28; 446/231

[58] Field of Search ..... 446/7, 28, 230, 231; 434/247, 258, 260; 272/1 R, 1 C; D21/77, 87, 90

[56] References Cited

U.S. PATENT DOCUMENTS

| | | | |
|---|---|---|---|
| D. 87,118 | 6/1932 | Knopf | D21/77 |
| D. 188,484 | 12/1960 | Ramniceanu | D21/77 |
| D, 189,098 | 10/1960 | Kreienbrink | D21/77 |
| 2,836,008 | 5/1958 | Nichols | 446/231 |
| 3,010,718 | 11/1961 | Pearson, Jr. | 272/1 C |
| 3,178,851 | 4/1965 | Gage | 446/28 |
| 3,186,124 | 6/1965 | Voss | 446/28 |
| 3,715,832 | 2/1973 | Torres | 446/7 |
| 4,043,075 | 8/1977 | Breneman | 446/230 |
| 4,717,365 | 1/1988 | Anderson et al. | 446/230 |

*Primary Examiner*—Robert A. Hafer
*Assistant Examiner*—Michael Brown
*Attorney, Agent, or Firm*—Norman B. Rainer

[57] ABSTRACT

A flight simulating aircraft toy is provided having a harness member adapted to be worn upon the chest of a child, and an aircraft model pivotably supported by the harness member. When the toy is worn by the child, the aircraft model can be manipulated to simulate actual flight movements. The aircraft model can also be removed from the harness for independent use.

8 Claims, 3 Drawing Sheets

FLIGHT SIMULATING TOY

BACKGROUND OF THE INVENTION

The present invention relates to toys, and more particularly concerns a toy capable of manipulation by a child in a manner to simulate the flying of an airplane.

Children's toys in the form of model airplanes are well known. Such toys can be hand held by the child while walking or running, and manipulated to simulate the motions of an actual airplane. U.S. Pat. Nos. 3,009,698 and 3,608,234 disclose large toy airplane structures that are worn by the child and manipulated while walking or running. Although the toys that are worn give a more realistic feeling of controlling the flight of an airplane, they are cumbersome, and generally do not provide more than one or two modes of manipulative motion. The relatively large size and fixed construction of earlier worn airplane toys generally thwarted variations in appearance, thereby restricting the versatility and appeal of the toy.

It is accordingly an object of the present invention to provide an aircraft toy adapted to be worn by a child and manipulated while running or walking.

It is another object of this invention to provide a toy as in the foregoing object having several modes of manipulative motion.

It is a further object of the present invention to provide a toy of the aforesaid nature having interchangable components which facilitate appearance variations.

It is a still further object of this invention to provide a toy of the aforesaid nature of durable, safe construction amenable to low cost manufacture.

These objects and other objects and advantages of the invention will be apparent from the following description.

SUMMARY OF THE INVENTION

The above and other beneficial objects and advantages are accomplished in accordance with the present invention by a flight simulating aircraft toy comprising:

(1) a harness member having a rigid base adapted to be disposed in front of the child and above waist level, compliant straps of adjustable effective length attached to said base and adapted to encircle the waist and shoulders of the child, and an action arm having a lower extremity pivotably attached to the base, and an upper extremity having a straight engagement rod terminating in a forwardly directed distal extremity, and resilient means attaching said action arm to said base in a manner to return said arm to said base from positions forwardly displaced therefrom, and (2) an aircraft model having a vertical plane of symmetry and a rear extremity having a straight channel whose axis is disposed within said plane of symmetry, said channel being adapted to receive said engagement rod in a manner to support said model and permit rotational movement thereof about said rod.

In preferred embodiments of the invention, the distal extremity of the engagement rod is provided with securing means which prevent removal of an aircraft model mounted upon said rod. The manner of pivotal attachment of the action arm to the base may be such as to permit swinging movement of the action arm within a vertical plane, or the attachment may be by way of a ball joint, thereby permitting omni-directional movement. When the harness member is properly worn, and the action member is in its uppermost position, the engagement rod is preferably disposed in a direction upwardly angled from horizontal. The engagement rod is preferably of circular cylindrical configuration, but in some variations may be of conical contour having an apex directed away from the base.

The aircraft models preferably have trigger mechanisms and associated projectile launching means. The wing components of the aircraft models are preferably removable, thereby facilitating storage and shipping, and permitting additional transformations of appearance. In fact, with the wings removed, certain models will more closely resemble a futuristic gun or rocket than an aircraft. In preferred embodiments, laterally opposed gripping means are equidistantly disposed on each side of the plane of symmetry adjacent the rear of the underside of the aircraft model. Such gripping means, which may be paired handle/trigger structures, or a simulated wheel or handlebar, facilitate two handed turning maneuvers of the aircraft. Such embodiments requiring two hand operation foster more complete psychological involvement of the child with the toy.

By virtue of the aforesaid construction and interaction of components, the present toy can be worn by a child, and, while running or walking, he can simulate various movements of an aircraft such as climbing, diving, rolls, and oblique maneuvers while simultaneously aiming and firing projectiles.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
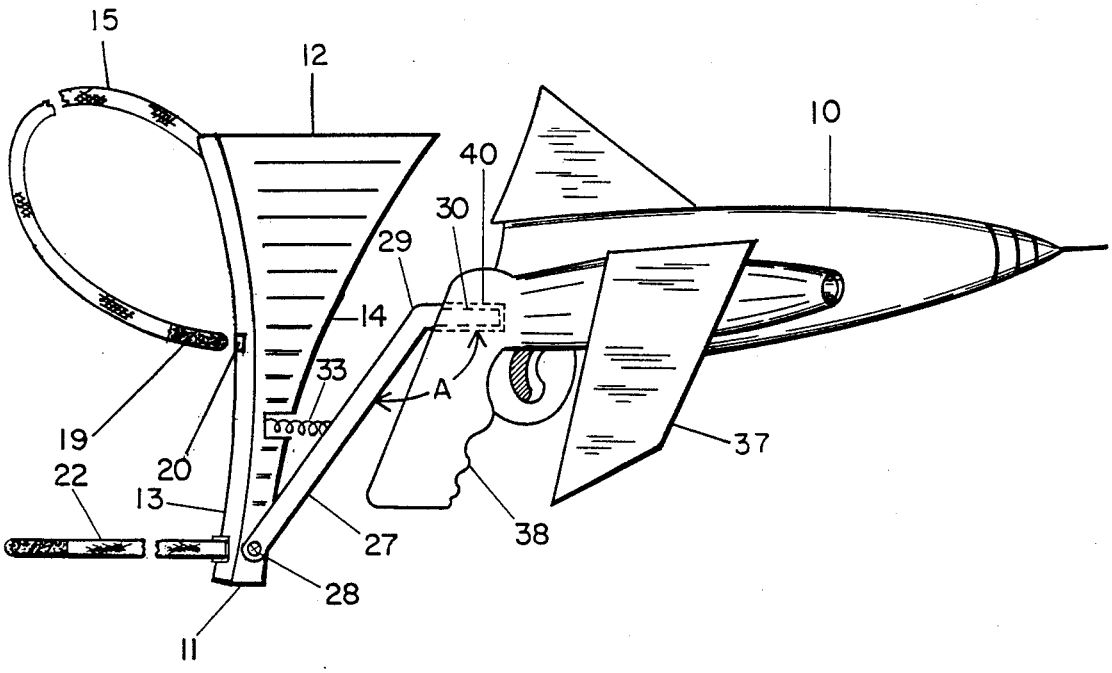
FIG. 1 is a side view of an embodiment of the toy of the present invention showing a harness member supporting an air craft model.
Figure 2:
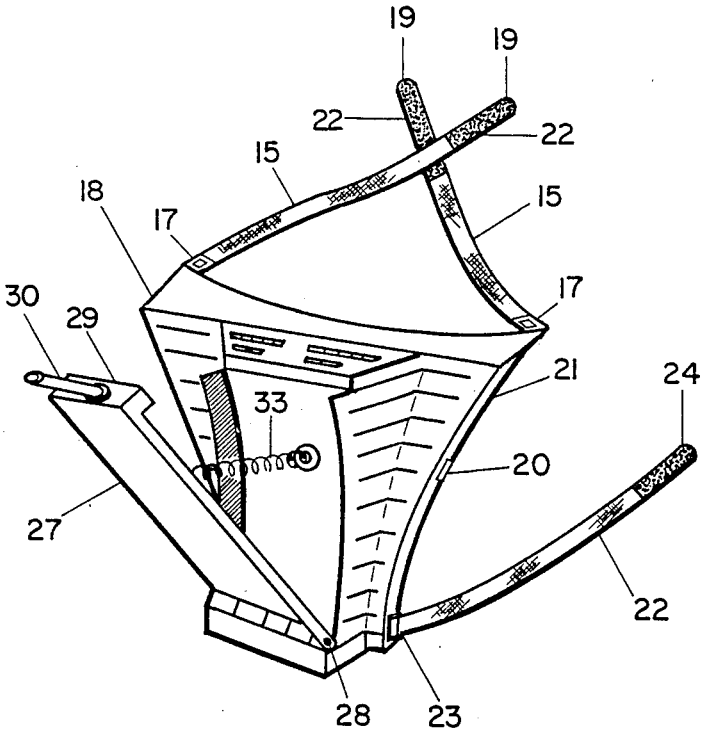
FIG. 2 is a front perspective view of the harness member of FIG. 1.
Figure 3:
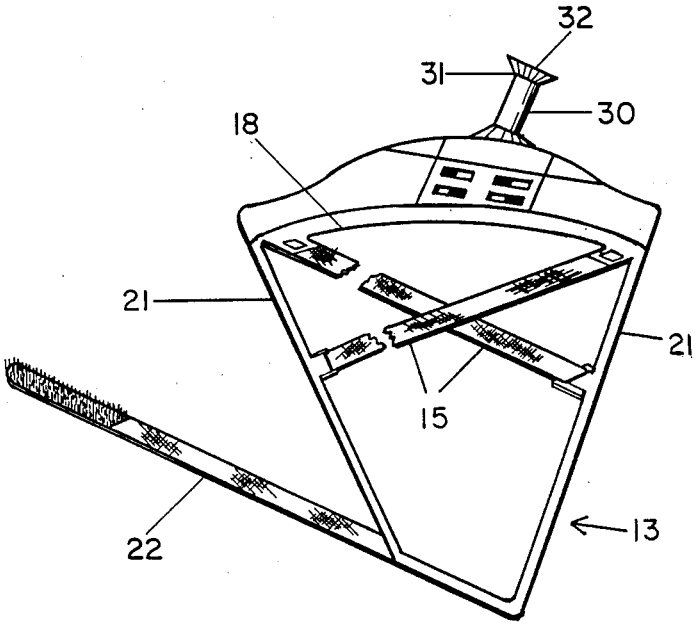
FIG. 3 is a rear perspective view of a harness member such as that shown in FIG. 1.
Figure 4:
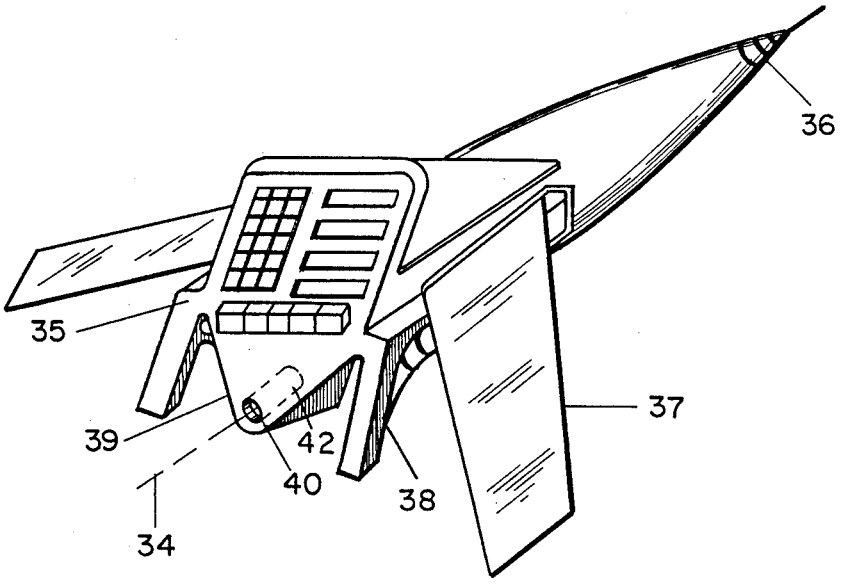
FIG. 4 is a perspective rear view of an aircraft model component of the toy such as that shown in FIG. 1.

Referring to FIGS. 1–5, an embodiment of the toy of the present invention is shown comprised of aircraft model 10 movably mounted upon harness member 11.

Said harness member is comprised of rigid base 12 having rear perimeter 13 adapted to abut against the body of the child who wears the toy, and forward portion 14. Paired shoulder straps 15 are attached at their proximal extremities 17 to the base at opposite extremities of the top edge 18 of rear perimeter 13. Said top edge 18 is less than twelve inches in length, and is arcuately contoured so as to fit comfortably against the child's chest. The distal extremities 19 of straps 15 are provided with Velcro attachment material 22, and are adapted to penetrate slots 20 in opposite sides 21 of perimeter 13. Once said distal extremities penetrate slots 20, they are folded upon themselves to achieve releasible securement by virtue of the Velcro material. In similar manner, a waist strap 22 is joined at its proximal extremity 23 to the base at the lowermost portion of a side 21 of perimeter 13. The distal extremity 24 of the waist strap is provided with Velcro attachment material and is adapted to penetrate slot 25 in the opposite side of perimeter 13.

Forward portion 14 of the base has a futuristic design, and may extend forwardly of rear perimeter 13 by about 1–4 inches. Action arm 27 is joined by hinge 28 to forward portion 14 adjacent the lowermost extremity thereof. Such manner of attachment enables arm 27 to swing in a vertical path. Although the exemplified embodiment of action arm 27 is in the form of a panel, alternative embodiments may be in the form of a rod or equivalent structure. The upper extremity 29 of arm 27, even at its highest point of swinging movement, is preferably located below top edge 18 of the base.

A straight engagement rod 30 is attached to upper extremity 29, said rod 30 terminating in a forwardly directed distal extremity 31. Rod 30 is forwardly disposed such as to form an angle A with respect to action arm 27 of between about 100 and 150 degrees. Such angular disposition enables the aircraft model to be positioned in realistic forwardly directed attitudes. Securing means in the form of removable resilient end cap 32 may be disposed upon distal extremity 31, the purpose of said end cap being to retain the aircraft model, as will hereinafter be shown.

Resilient means in the form of coil spring 33 attaches arm 27 to the forward portion 14 of the base in a manner to return the arm to the base from positions forwardly displaced therefrom. In alternative embodiments, the resilient means may be a rubber band or equivalent structure.

Aircraft model 10 is symmetrically configured about a vertically bisecting plane 43 that includes the axis of elongation 34. The model tapers in a futuristic design between rear extremity 35 and front extremity 36. Removable wings 37 are laterally disposed upon the model. Opposed dual combined handgrips and trigger mechanisms 38 are disposed upon the underside of the model adjacent the rear extremity thereof. A rear panel 39 extends between the two handgrip/trigger mechanisms 38. A receiving channel 40 is disposed within panel 39 in a manner permitting close-fitting insertion of engagement rod 30. Once inserted, rod 30 supports the aircraft model in a manner permitting rotation of the model about the rod. After insertion of rod 30, end cap 32 may optionally be re-applied to distal extremity 31 of the rod, thereby preventing inadvertent separation of the model from the harness member. In embodiments utilizing an end cap, it is necessary that the distal extremity 42 of channel 40 be open to permit penetration by the distal extremity 31 of rod 30.

Figure 5:
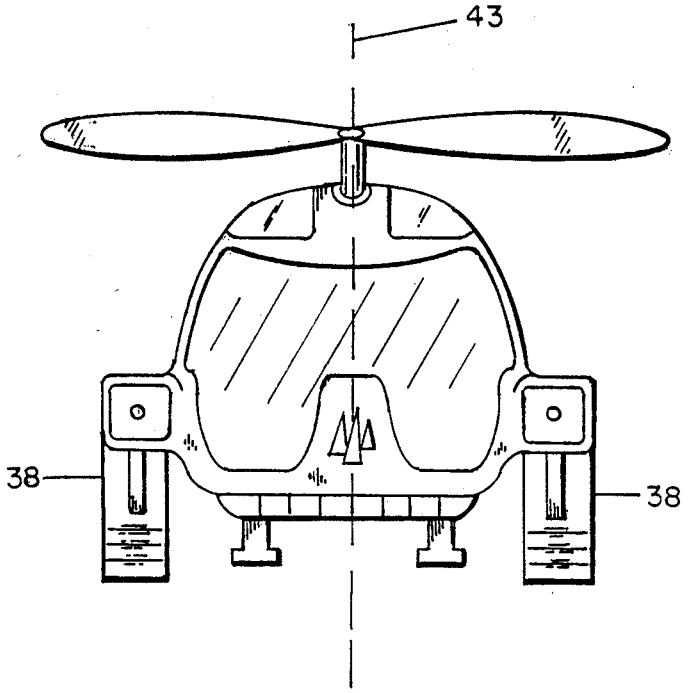
FIG. 5 is a front view of an alternative embodiment of aircraft model component useful in the toy of FIG. 1.

The aircraft model may have numerous different shapes and appearances, including jet fighters, rocket ships, and helicopters, as shown in FIG. 5. The appearance may be further modified by adhesive decals which may be applied by the child to suit his particular preferences. The base, action arm, and aircraft model may be fabricated of impact resistant thermoplastic by injection molding techniques. Varied colors may be incorporated into the thermoplastic for enhanced visual effects.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A flight simulating aircraft toy comprising:

(a) a harness member having a rigid base adapted to be disposed in front of the child and above waist level, and compliant straps of adjustable effective length attached to said base and adapted to encircle the waist and shoulders of the child, (b) an action arm having a lower extremity pivotably attached to said rigid base, and having an upper extremity capable of displacement away from said rigid base in a circular arc, (c) a straight engagement rod attached to the upper extremity of said action arm and terminating in a forwardly directed distal extremity, (d) resilient means attaching said action arm to said rigid base in a manner to return said arm to said rigid base, and (e) an aircraft model having a vertical plane of symmetry and having a rear extremity having straight channel means whose axis is disposed within said plane of symmetry, said channel means being adapted to receive said engagement rod in a manner to support said model and permit rotational movement thereof about said rod.

2. The toy of claim 1 wherein said engagement rod and channel means are of circular cylindrical configuration.

3. The toy of claim 2 wherein said channel means has an open distal extremity through which the distal extremity of said engagement rod penetrates, and securing means removably associated with the distal extremity of said rod to prevent inadvertment removal of the aircraft model from said engagement rod.

4. The toy of claim 1 further equipped with laterally opposed gripping means equidistantly disposed on each side of the plane of symmetry adjacent the rear of the underside of the aircraft model.

5. The toy of claim 4 wherein said gripping means are paired handles having trigger mechanisms.

6. The toy of claim 1 wherein the manner of pivotal attachment of said action arm to said base is such as to permit swinging movement of the action arm within a vertical path.

7. The toy of claim 1 wherein the manner of pivotal attachment of said action arm to said base is such as to permit omni-directional movement of said action arm.

8. The toy of claim 1 wherein the aircraft model is provided with removable wings.

* * * * *